US006499482B1

(12) United States Patent
Hung

(10) Patent No.: US 6,499,482 B1
(45) Date of Patent: Dec. 31, 2002

(54) DISCHARGE TUBE SHIELDING HOOD FOR AN EXTRACTOR

(76) Inventor: Shun-Chang Hung, No.41, Lane 320, Sec. 1, Sha-Tien Rd., Tatu County, Taichung Hsien (TW)

( * ) Notice: Subject to any disclaimer, the term of this patent is extended or adjusted under 35 U.S.C. 154(b) by 0 days.

(21) Appl. No.: 09/938,090

(22) Filed: Aug. 24, 2001

(51) Int. Cl.[7] ..... F24C 15/20

(52) U.S. Cl. ..... 126/299 R; 126/299 D; 285/45

(58) Field of Search ..... 126/299 R, 299 D, 126/301, 307 R; 454/63, 64, 67; 285/45, 46, 302; 403/109.1, 109.4, 377, 378, 379.1, 379.3

(56) References Cited

U.S. PATENT DOCUMENTS 368,231 A * 8/1887 Parks ..... 126/299 D
2,931,669 A * 4/1960 McDonald ..... 285/45

FOREIGN PATENT DOCUMENTS

DE 19814000 A1 * 9/1999
DE 29914232 U1 * 1/2000

* cited by examiner

*Primary Examiner*—Sara Clarke
(74) *Attorney, Agent, or Firm*—Charles E. Baxley

(57) ABSTRACT

In a discharge tube shielding hood for an extractor hood, a top side of the extractor hood is provided with a positioning seat for extension of a discharge tube therethrough. The positioning seat is insertably connected to a retractable shielding hood unit, which includes a first shielding plate having a bottom end slidably inserted into the positioning seat, and a second shielding plate that is partly disposed in the first shielding plate. The first and second shielding plates are locked and positioned by screws. The shielding hood unit can shield the discharge tube and has a two-stage retractable construction to facilitate mounting and positioning and to adapt to different mounting heights.

10 Claims, 7 Drawing Sheets

DISCHARGE TUBE SHIELDING HOOD FOR AN EXTRACTOR

BACKGROUND OF THE INVENTION (a) Field of the Invention

The present invention relates to an extractor hood, more particularly to a discharge tube shielding hood for an extractor hood.

(b) Description of the Prior Art

An extractor hood generally includes a housing, in which is disposed a wind belly. The wind belly includes two motor fan units for extracting oily smoke generated during cooking. A top side of the wind belly is coupled to a discharge tube, which can extend upwardly and outdoors to discharge the extracted smoke to the outside. In terms of the appearance and environment of the kitchen, exposing the discharge tube is unsightly. Besides, the folds of the discharge tube can easily trap oily dirt, which is difficult to clear. A conventional way is to mount the extractor hood under a suspension type cabinet and to conceal the discharge tube inside the cabinet. However, this method is costly. Besides, as the cabinet is fixed, it poses certain restrictions in future replacement of the extractor hood.

SUMMARY OF THE INVENTION

The primary object of the present invention is to provide a discharge tube shielding hood for an extractor hood. The shielding hood can shield the discharge tube to prevent exposure of the discharge tube so as not to affect the environment and appearance of the kitchen and to protect the discharge tube so as to prevent accumulation of dirt thereon, which is difficult to clear. The shielding hood has a two-stage retractable construction to facilitate mounting and positioning and to adapt to different mounting heights. Moreover, the structure is light and inexpensive to manufacture and is removable so as not to pose restrictions on future replacement of the extractor hood in terms of environment.

Accordingly, the extractor hood includes a housing, in which a wind belly is disposed. A top side of the wind belly is provided with an outlet, which is connected to a discharge tube. A top side of the housing is formed with an opening for passage of the discharge tube therethrough. The discharge tube shielding hood includes a positioning seat disposed at the opening in a top portion of the housing. The positioning seat is centrally provided with a hole for extension of the discharge tube. The positioning seat is insertably connected to a bottom portion of a retractable shielding hood unit. The shielding hood unit includes: a first shielding plate having a surface plate and two side plates, bottom ends of the two side plates being slidably inserted into the positioning seat; and a second shielding plate having a surface plate and two side plates, the second shielding plate having an outer peripheral size corresponding to the inner peripheral size of the first shielding plate. The second shielding plate is partly disposed in the first shielding plate. The first and second shielding plates are positioned by screws.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
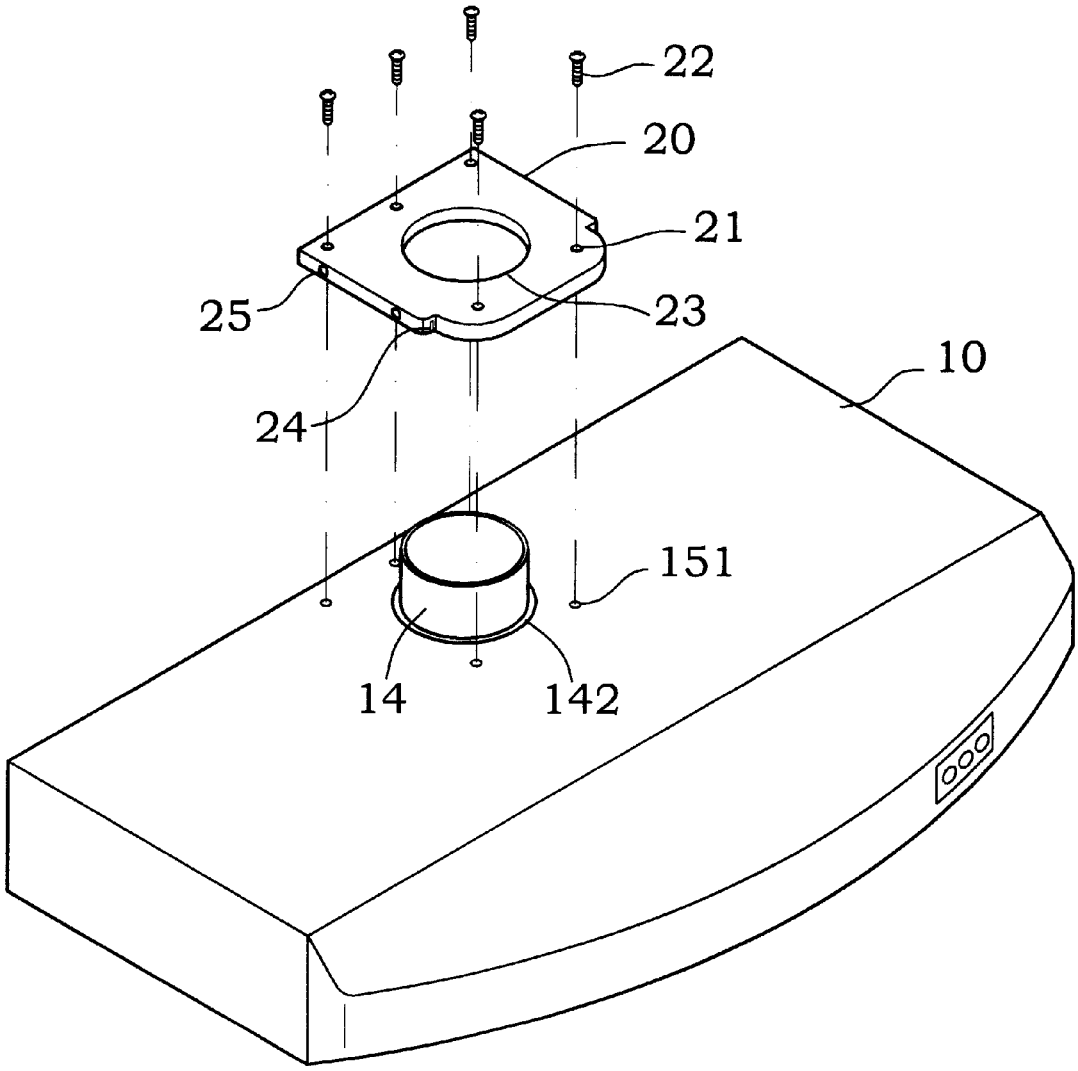
FIG. 1 is an exploded perspective view of an extractor hood and a positioning seat according to the present invention.
Figure 5:
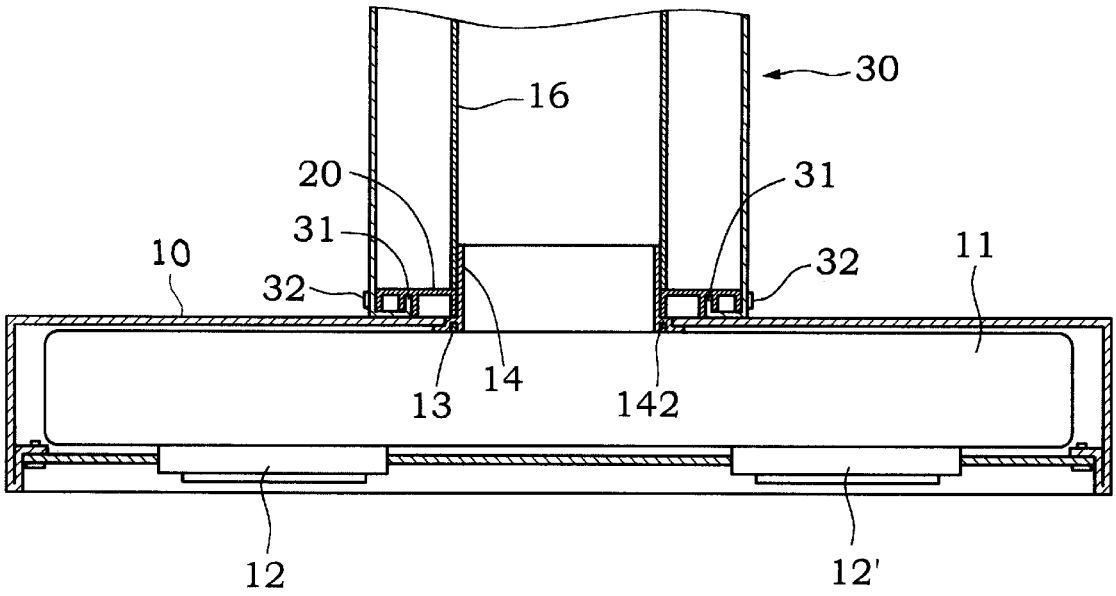
FIG. 5 is a sectional view taken along line 5—5 of FIG. 4.
Figure 6:
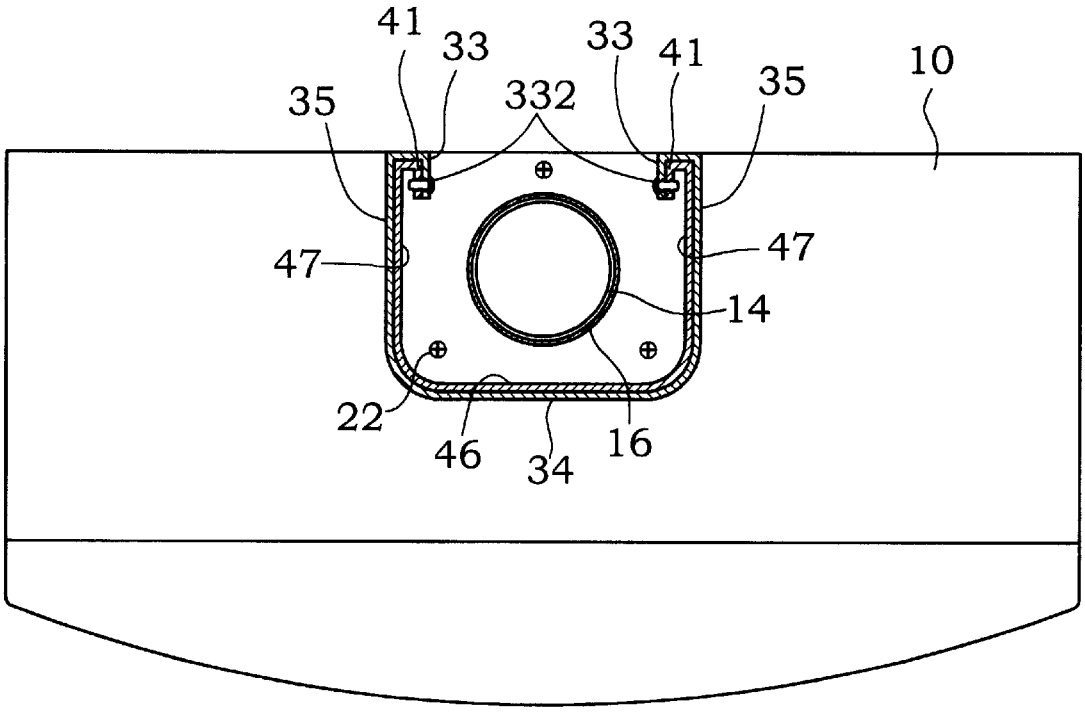
FIG. 6 is a sectional view taken along line 6—6 of FIG. 4.
Figure 7:
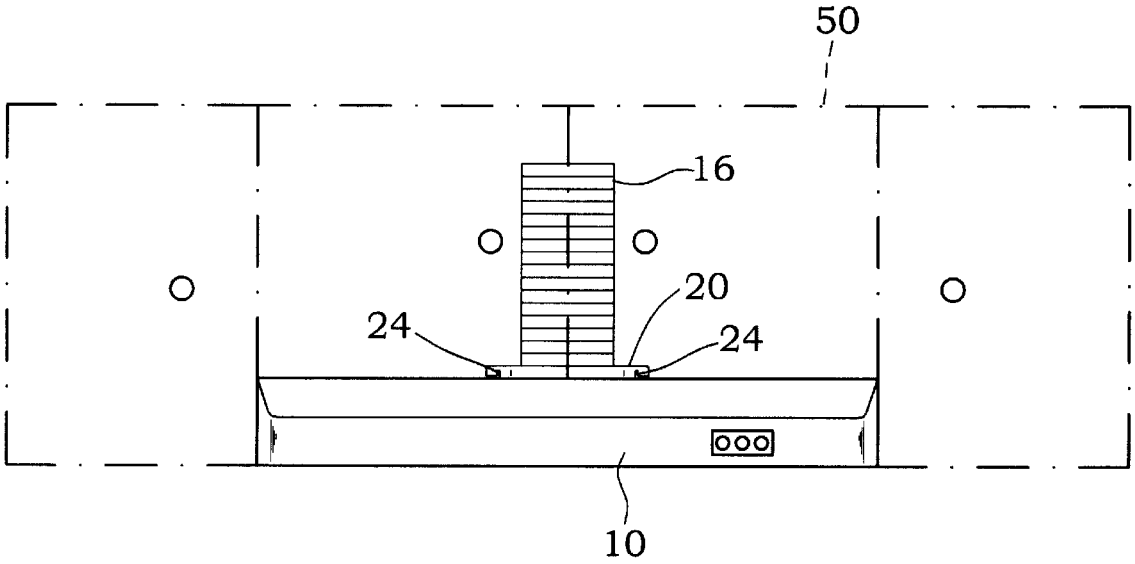
FIG. 7 is a schematic view illustrating how the present invention is mounted below a cabinet.

Referring to FIGS. 1 and 5, a discharge tube shielding hood for an extractor hood according to the present invention includes a housing 10, in which is disposed a wind belly 11. The wind belly 11 is provided with two motor fan units 12, 12' for extracting oily smoke generated during cooking. The center of a top side of the wind belly 11 is provided with an outlet. The peripheral edge of the outlet is configured as an upwardly projecting flange 13 for coupling a discharge tube 14 that is formed from rigid plastic. In order that the coupling is more secure, the tube end of the discharge tube 14 is provided with a thick wall section 142, and is axially provided with a fitting groove that corresponds in depth to the flange 13 for insertable fitting of the flange 13 so that the discharge tube 14 can be coupled to the outlet of the wind belly 11. A top side of the housing 10 is provided with an opening for extension of the discharge tube 14. A top portion of the housing 10 is provided with a positioning seat 20.

Figure 2:
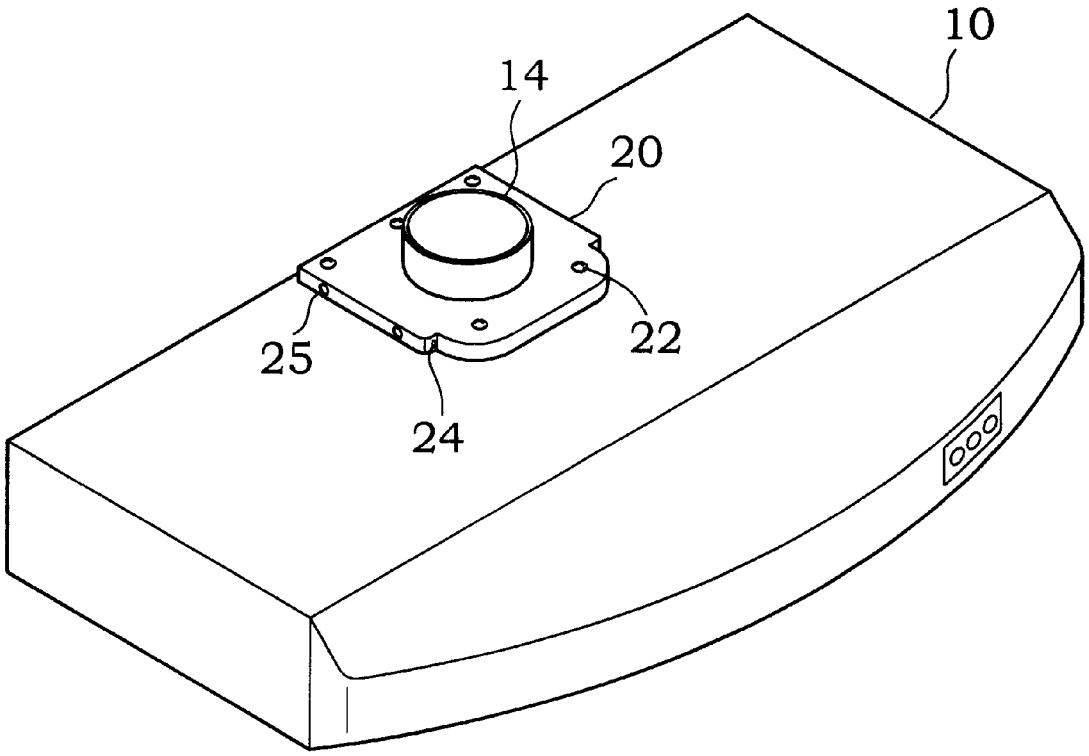
FIG. 2 is a perspective assembled view of the extractor hood and the positioning seat according to the present invention.

Referring to FIGS. 1 and 2, front and rear edge portions of the positioning seat 20 and the peripheral wall surface of the opening are respectively provided with a plurality of lock holes 21, 151 at corresponding positions for passage of screws 22 therethrough so as to lock the positioning seat 20 on the top portion of the housing 10. The center of the positioning seat 20 is provided with a hole 23 for extension of the discharge tube 14 therethrough. The bottom end of the wall of the hole abuts against the top end of the thick wall section 142 of the discharge tube 14. The open end portion of the discharge tube 14 is connected to a flexible discharge hose 16. Left and right sides of the positioning seat 20 are respectively provided with grooves 24. The side walls are provided with a plurality of lock holes 25. The positioning seat 20 is provided to connect to a shielding hood unit.

Figure 3:
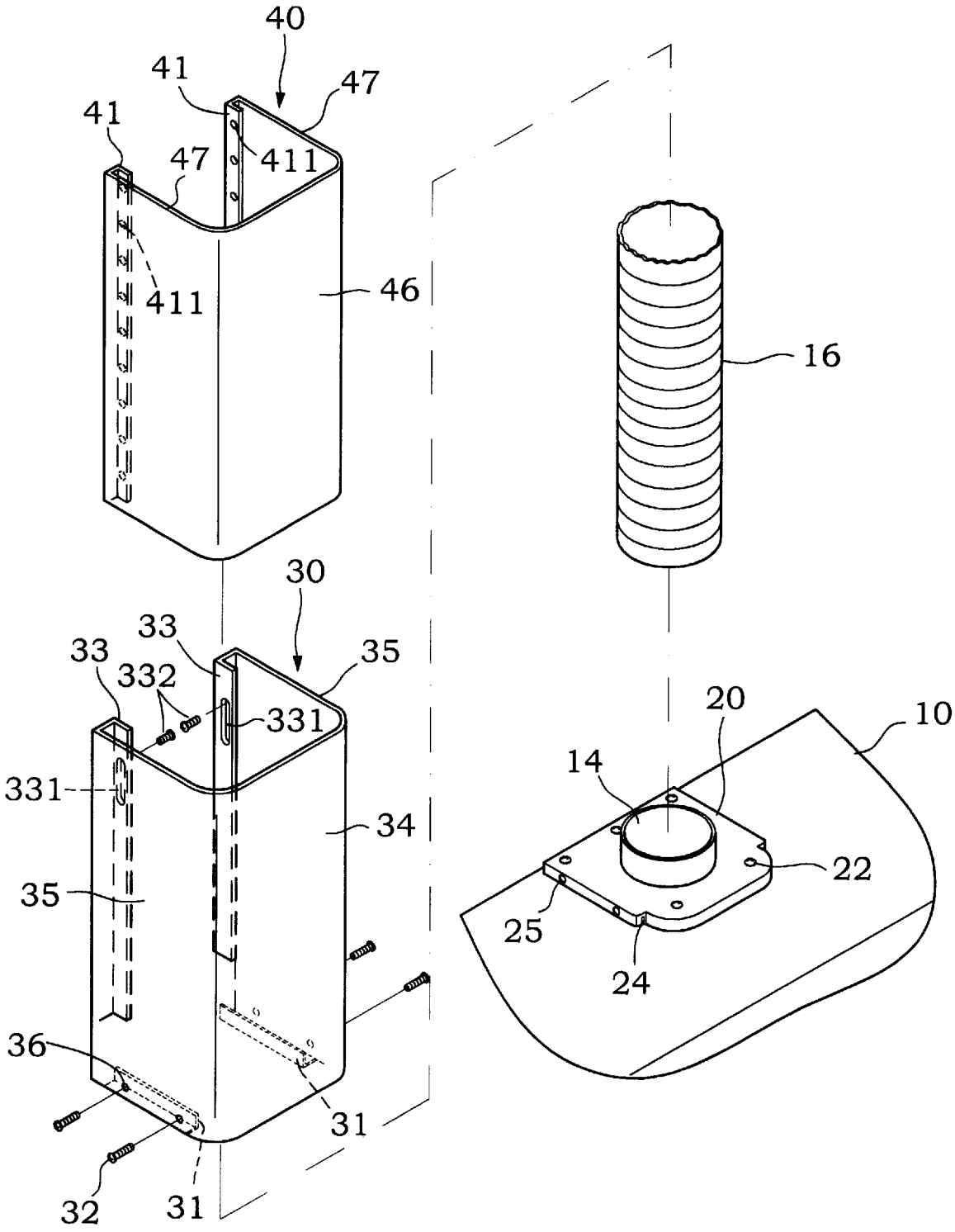
FIG. 3 is an exploded perspective view of the discharge tube shielding hood according to the present invention.
Figure 4:
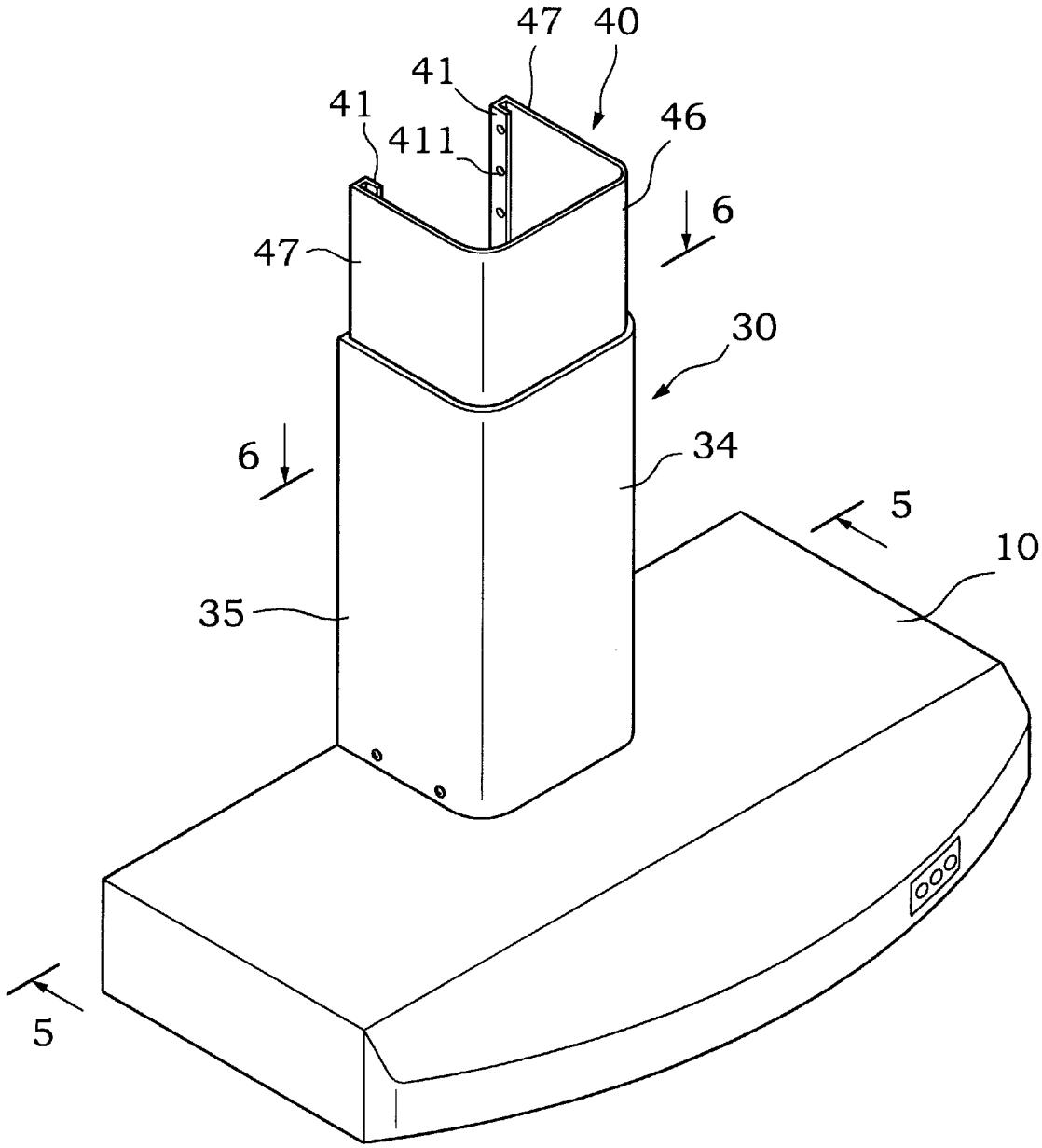
FIG. 4 is a perspective assembled view of the discharge tube shielding hood and the extractor hood according to the present invention.

Referring to FIGS. 3, 4 and 5, the shielding hood unit includes first and second shielding plates 30, 40.

The first shielding plate 30 has a surface plate 34 and two side plates 35. The bottom ends of the two side plates 35 are respectively bent in an L-shape to form a retaining edge 31. The first shielding plate 30 is slidably inserted along the grooves 24 from the front of the positioning seat 20. Screws 32 are used to pass through lock holes 36 in the bottom side edges into the lock holes 25 in the positioning seat 20 to secure the first shielding plate 30. The vertical open end portions of the two side plates 35 are respectively bent inwardly to form a respective first stop edge 33, which is provided with an elongate hole 331.

The second shielding plate 40 has a surface plate 46 and two side plates 47. The outer peripheral size thereof corresponds to the inner peripheral size of the first shielding plate

30. The vertical open end portions of the two side plates are also respectively bent inward to form a respective second stop edge 41, which is spacedly provided with a plurality of lock holes 411. The second shielding plate 40 is disposed inwardly of the first shielding plate 30. The surface plate 46, the two side plates 47 and the second stop edges 41 respectively abut against the inner sides of the surface plate 34, the two side plates 35 and the first stop edges 33 of the first shielding plate 30. The second shielding plate 40 is pulled to a suitable height with one of the lock holes 411 registered with the respective elongate hole 331, and the first and second shielding plates 30, 40 are secured together by passing screws 332 through the elongate holes 331 and the corresponding lock holes 411.

In general, the mounting position of an extractor hood can be divided into shielded type and non-shielded type. In a shielded type, the extractor hood is mounted below a kitchen cabinet, and the discharge tube can be shielded by the cabinet. In the non-shielded type, the extractor hood and the discharge tube thereof are not shielded by any object. The present invention is suited for mounting in a shielded or non-shielded manner. When the present invention is used in the non-shielded type environment, the mode shown in FIG. 4 is adopted, in which the shielding hood unit shields the discharge tube 14 and the discharge hose 16 to prevent exposure of the same so as not to affect the appearance and environment of the kitchen, and to protect the same so as to prevent accumulation of dirt thereon, which is difficult to clear. The discharge tube shielding hood has a two-stage type retractable construction, which is convenient and quick to position and can adapt to different mounting positions. The structure is compact, inexpensive to manufacture, and is removable to facilitate future replacement of the extractor hood. When the present invention is used in the shielded type, the shielding hood unit can be dispensed with, but the positioning seat 30 still has to be mounted on the extractor hood so as to position the discharge tube 14. The discharge hose 16 connected to the discharge tube 14 is shielded by the cabinet 50.

What is claimed is:

1. A discharge tube shielding hood for an extractor hood, comprising:

a discharge tube fitted to an outlet of a wind belly within said extractor hood;

a positioning seat provided at a top portion of a housing of said extractor hood, said positioning seat being centrally provided with a hole for extension of said discharge tube; and a shielding hood unit with a bottom end insertably connected to said positioning seat.

2. A discharge tube shielding hood for an extractor hood as claimed in claim 1, wherein said positioning seat is locked to said top portion of said housing by a plurality of screws.

3. A discharge tube shielding hood for an extractor hood as claimed in claim 2, wherein said shielding hood unit is retractable to allow length adjustment.

4. A discharge tube shielding hood for an extractor hood as claimed in claim 3, wherein said shielding hood unit includes a first shielding plate with a bottom end slidably inserted in said positioning seat, and a second shielding plate provided in said first shielding plate.

5. A discharge tube shielding hood for an extractor hood as claimed in claim 4, wherein said first shielding plate has a surface plate and two side plates, and said second shielding plate also has a surface plate and two side plates.

6. A discharge tube shielding hood for an extractor hood as claimed in claim 5, wherein each of said two side plates of said first shielding plate has a bottom end that bends inwardly to form a retaining edge, bottom portions of left and right sides of said positioning seat being respectively provided with grooves for slidable insertion of said retaining edges.

7. A discharge tube shielding hood for an extractor hood as claimed in claim 4, wherein said two side plates of said first shielding plate respectively have vertical open end edges each of which bends inwardly toward the interior of said first shielding plate so as to form a respective first stop edge, and said two side plates of said second shielding plate respectively have vertical open end edges each of which bends inwardly toward the interior of said second shielding plate so as to form a respective second stop edge.

8. A discharge tube shielding hood for an extractor hood as claimed in claim 7, wherein said first stop edge is provided with an elongate hole, and said second stop edge is provided with a plurality of lock holes, one of said lock holes being aligned with said elongate hole for passage of a screw element therethrough so as to secure said first and second shielding plates.

9. A discharge tube shielding hood for an extractor hood as claimed in claim 4, wherein at least one screw locks and positions said first and second shielding plates.

10. A discharge tube shielding hood for an extractor hood as claimed in claim 4, wherein at least one of said plurality of screws locks said first shielding plate and said positioning seat.

* * * * *